US007210414B1

(12) United States Patent
Barone

(10) Patent No.: US 7,210,414 B1
(45) Date of Patent: May 1, 2007

(54) FOLDING TABLE FOR MOUNTING ON HANDRAIL

(76) Inventor: Joseph Barone, 2288A Vineyard Rd., Novato, CA (US) 94947

( * ) Notice: Subject to any disclaimer, the term of this patent is extended or adjusted under 35 U.S.C. 154(b) by 308 days.

(21) Appl. No.: 11/002,000

(22) Filed: Dec. 2, 2004

Related U.S. Application Data

(60) Provisional application No. 60/529,808, filed on Dec. 16, 2003.

(51) Int. Cl.
*A47B 23/00* (2006.01)

(52) U.S. Cl. ..... 108/42; 108/152; 248/229.15

(58) Field of Classification Search ..... 108/42, 108/152, 40, 48; 211/90, 90.01, 87.01, 86.01, 211/88.01, 90.02; 248/245, 235, 240, 241, 248/205.1, 238, 218.4, 219.1, 229.15
See application file for complete search history.

(56) References Cited

U.S. PATENT DOCUMENTS

| | | | | |
|---|---|---|---|---|
| 7,058 | A * | 1/1850 | Blom | 57/70 |
| 1,174,755 | A * | 3/1916 | Mullen | 108/47 |
| 1,557,402 | A | 10/1925 | Bateson | |
| 2,249,403 | A | 7/1941 | Stollsteimer | |
| 2,483,899 | A | 10/1949 | Grasso et al. | |
| 2,855,504 | A | 10/1958 | MacDougal et al. | |
| 4,446,796 | A | 5/1984 | Wilson et al. | |
| 4,889,057 | A * | 12/1989 | Chartrand | 108/42 |
| 4,998,484 | A * | 3/1991 | Groetzinger | 108/42 |
| 5,033,448 | A * | 7/1991 | Sandweg | 126/25 R |
| 5,355,810 | A * | 10/1994 | Camilleri | 108/42 |
| 5,528,993 | A | 6/1996 | Vincelli | |
| 5,653,178 | A * | 8/1997 | Huczka | 108/47 |
| 5,722,329 | A * | 3/1998 | Weng | 108/47 |
| 6,098,552 | A * | 8/2000 | Gunderson | 108/108 |
| 6,546,879 | B1 * | 4/2003 | Johnston | 108/47 |
| 6,604,472 | B2 * | 8/2003 | McNeil | 108/42 |
| 6,705,235 | B1 * | 3/2004 | Gerutto | 108/47 |
| 6,931,998 | B1 * | 8/2005 | Leese | 108/42 |
| 7,121,213 | B2 * | 10/2006 | Viazanko et al. | 108/42 |

* cited by examiner

*Primary Examiner*—Jose V. Chen
(74) *Attorney, Agent, or Firm*—Jack Lo

(57) ABSTRACT

A folding table is comprised of a platform connected by hinges to mounting brackets that partially wrap around the vertical supports of a handrail. Slits extend down from the upper edges of the brackets to mate with slits extending up from the lower edges of locking plates on an opposite side of the vertical supports. One of the mounting bracket is a vertically elongated bracket. A folding diagonal brace comprised of upper and lower braces is connected between a lower side of the platform and the elongated bracket. A lower pin at the lower end of the upper brace is positioned through a longitudinal slot in the lower brace. An upper pin on the upper brace is positioned in a coiled slot at an upper end of the lower brace when the platform is fully raised and the diagonal brace is straightened.

5 Claims, 3 Drawing Sheets

FOLDING TABLE FOR MOUNTING ON HANDRAIL

CROSS REFERENCE TO RELATED APPLICATION

I claim the priority of provisional patent application 60/529,808 filed on Dec. 16, 2003.

BACKGROUND OF THE INVENTION

1. Field of the Invention

The invention broadly relates to folding tables.

2. Prior Art

Folding tables are convenient for supporting things when needed, and compacting for occupying a smaller space when not in use. Some folding tables are designed for attaching to a vertical structure, such as the support rods of a handrail. U.S. Pat. No. 5,528,993 to Vincelli discloses a folding table with a hinged tabletop screwed to a mounting plate positioned on the opposite side of the support rods. The leg is inserted into a sleeve under the tabletop, so that the leg must be detached for folding. The table is not easily removable from the handrail. U.S. Pat. No. 2,483,899 to Grasso and U.S. Pat. No. 2,249,403 to Stollsteimer each show a folding table with a convenient folding diagonal brace, but the table is still permanently attached to the support by bolts.

BRIEF SUMMARY OF THE INVENTION

Objects of the present folding table are:

to provide a horizontal supporting surface;

to be attachable to the vertical support rods of a handrail;

to provide a supporting surface which can be easily compacted with not in use; and to be easily detachable from the handrail.

The present folding table is comprised of a platform connected by hinges to C-shaped mounting brackets that partially wrap around the vertical supports of a handrail. Slits extend down from the upper edges of the brackets to mate with slits extending up from the lower edges of locking plates on an opposite side of the vertical supports. One of the mounting bracket is a vertically elongated bracket. A folding diagonal brace is connected between a lower side of the platform and the elongated bracket. The diagonal brace is comprised of an upper brace connected by hinges to the platform, and a lower brace connected by a hinge to the elongated bracket. The upper brace is comprised of a pair of bars with flared upper ends for stability, and parallel lower ends positioned against opposite sides of the lower brace. A lower pin connected between the parallel lower ends of the bars is positioned through a longitudinal slot in the lower brace. An opening in the longitudinal slot allows the lower pin to slide in from the outside. An upper pin connected between the parallel lower ends of the bars is positioned in a coiled slot at an upper end of the lower brace. A notch on a lower edge of the lower brace provides clearance for the upper pin after the diagonal brace is folded. When the platform is fully raised and the diagonal brace is straightened, the lower pin is positioned at a lower end of the longitudinal slot, and the upper pin is positioned at the inner end of the coiled slot. When folding, the lower end of the upper brace and the upper end of the lower brace are pushed inward. The upper pin is guided out of the coiled slot and released from the lower brace. The lower pin is moved up along the longitudinal slot as the upper and lower braces are folded. The platform is pivoted downward during folding. When folded, the upper and lower braces are generally parallel to each other. The lower pin is moved to the upper end of the longitudinal slot, and the upper pin is positioned in the notch on the upper brace.

Figure 1:
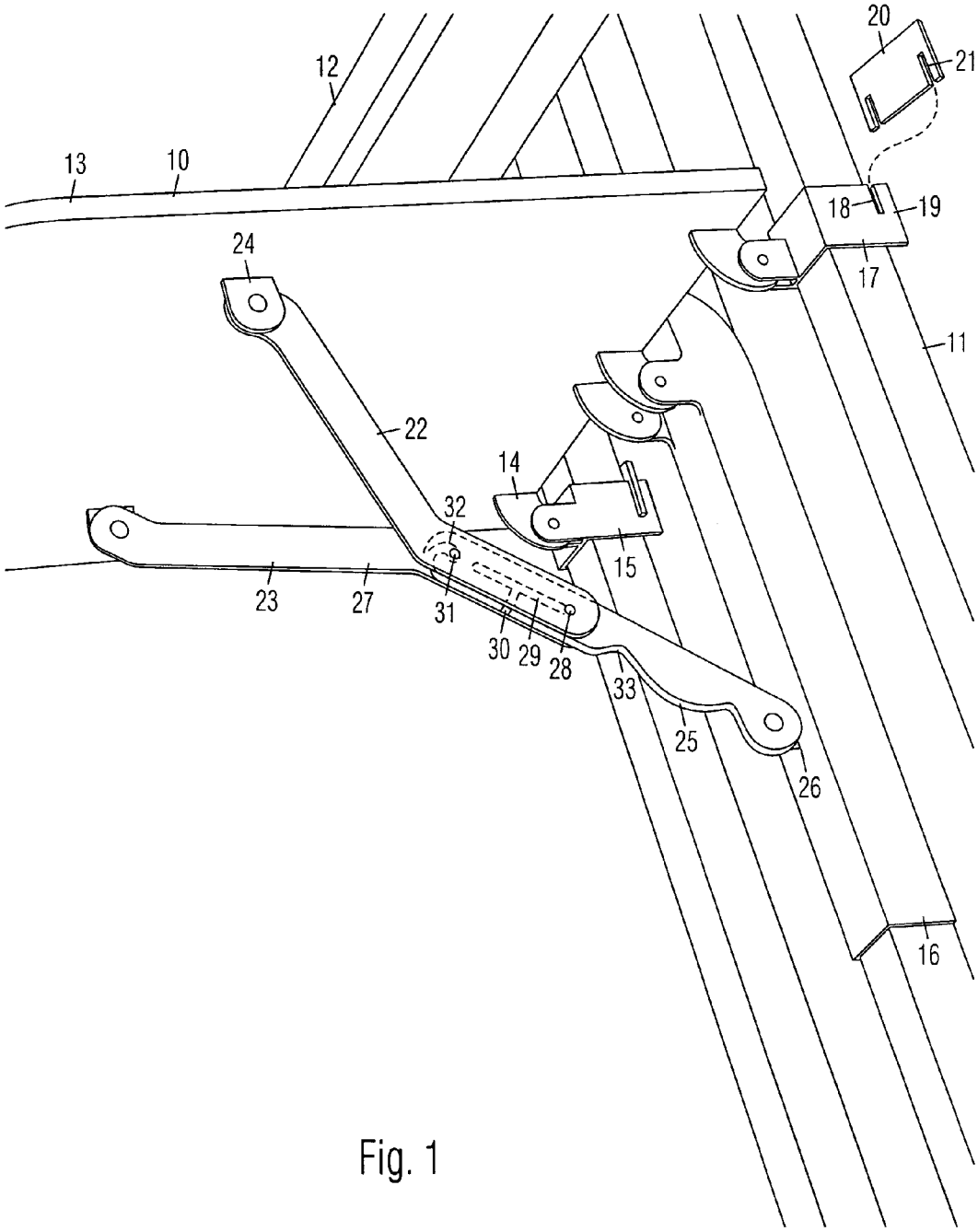
FIG. 1 is a bottom perspective view of the folding table in an raised position.

| DRAWING REFERENCE NUMERALS | |
|---|---|
| 10. Table | 11. Support |
| 12. Hand Rail | 13. Platform |
| 14. Hinge | 15. Bracket |
| 16. Bracket | 17. Bracket |
| 18. Slit | 19. Arm |
| 20. Plate | 21. Slit |
| 22. Diagonal Brace | 23. Upper Brace |
| 24. Hinge | 25. Lower Brace |
| 26. Hinge | 27. Bar |
| 28. Lower Pin | 29. Slot |
| 30. Opening | 31. Upper Pin |
| 32. Coiled Slot | 33. Notch |

DETAILED DESCRIPTION OF THE INVENTION

FIG. 1:

A folding table 10 is arranged for mounting on the vertical supports 11 of a hand rail 12. A preferred embodiment of table 10 is comprised of a platform 13 connected by hinges 14 to mounting brackets 15–17 at a proximal end. Brackets 15–17 are comprised of C-shaped clips that wrap around the front and sides of supports 11. Slits 18 extend down from the upper edges of side arms 19 of brackets 15 and 17. Locking plates 20 each include slits 21 extending up from a lower edge for mating with slits 18 on side arms 19 to secure brackets 15 and 17 on supports 11. Second mounting bracket 16 is a vertically elongated bracket.

A folding diagonal brace 22 is connected between a lower side of platform 13 and second mounting bracket 16. Diagonal brace 22 is comprised of an upper brace 23 connected by hinges 24 to platform 13, and a lower brace 25 connected by a hinge 26 to second mounting bracket 16. Upper brace 23 is comprised of a pair of bars 27 with upper portions diverged away from each other, and parallel lower portions positioned against opposite sides of lower brace 25. A lower pin 28 connected between parallel lower portions of bars 27 is positioned through a longitudinal slot 29 in lower brace 25. An opening 30 in longitudinal slot 29 allows lower pin 28 to slide in. An upper pin 31 connected between parallel lower portions of bars 27 is positioned in a coiled slot 32 at an upper end of lower brace 25. A notch 33 on a lower edge of lower brace 25 provides clearance for upper pin 31 after diagonal brace 22 is folded. When platform 13 is fully raised and diagonal brace 22 is straightened, lower pin 28 is positioned at a lower end of longitudinal slot 29.

Figure 2:
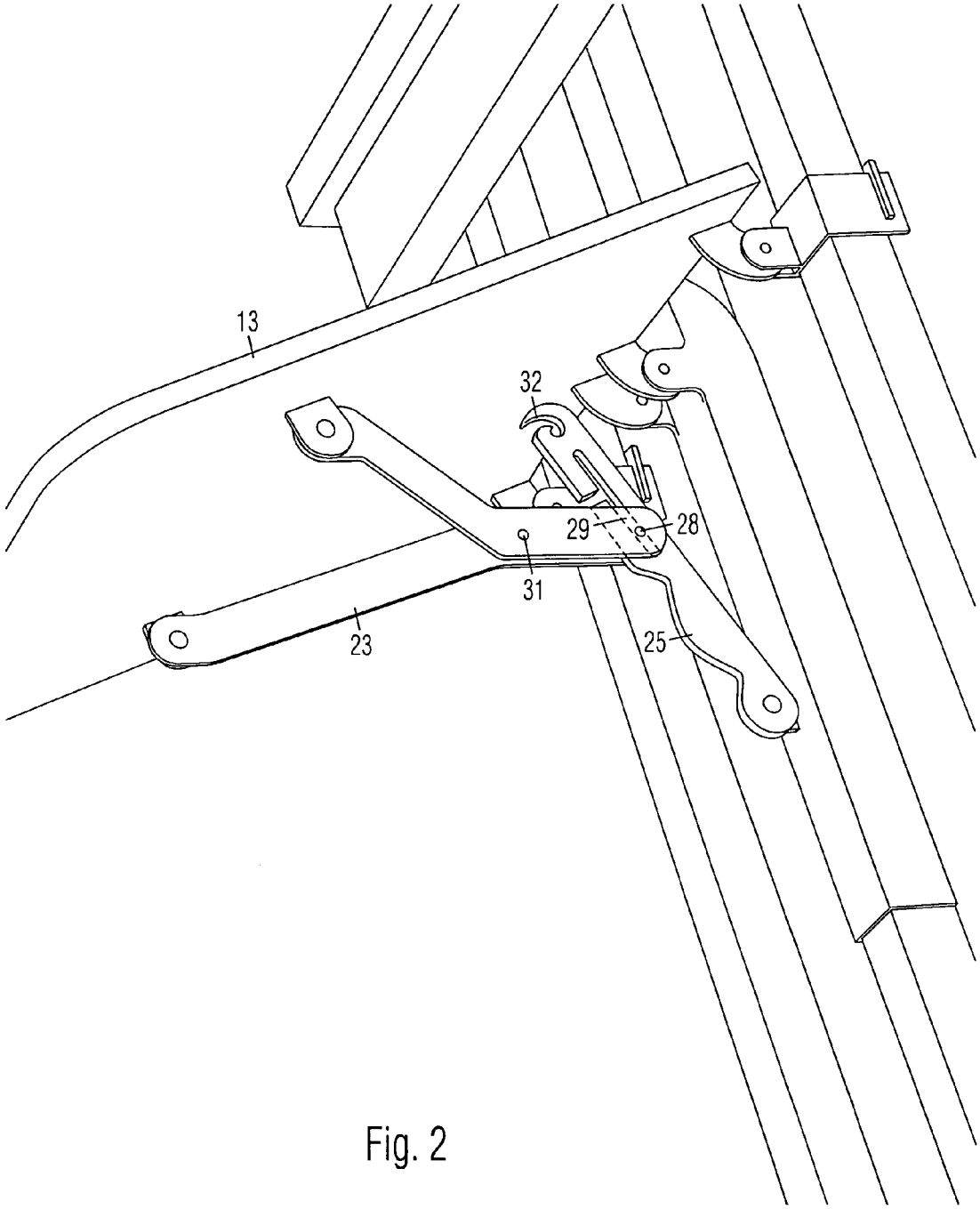
FIG. 2 shows the folding table being folded.

FIG. 2:

Platform 13 is shown during folding in FIG. 2. The lower end of upper brace 23 and the upper end of lower brace 25 are pushed inward. Upper pin 31 is guided out of coiled slot 32 and released from lower brace 25. Lower pin 28 is moved up along longitudinal slot 29 as upper and lower braces 23 and 25 are folded. Platform 13 is pivoted downward during folding.

Figure 3:
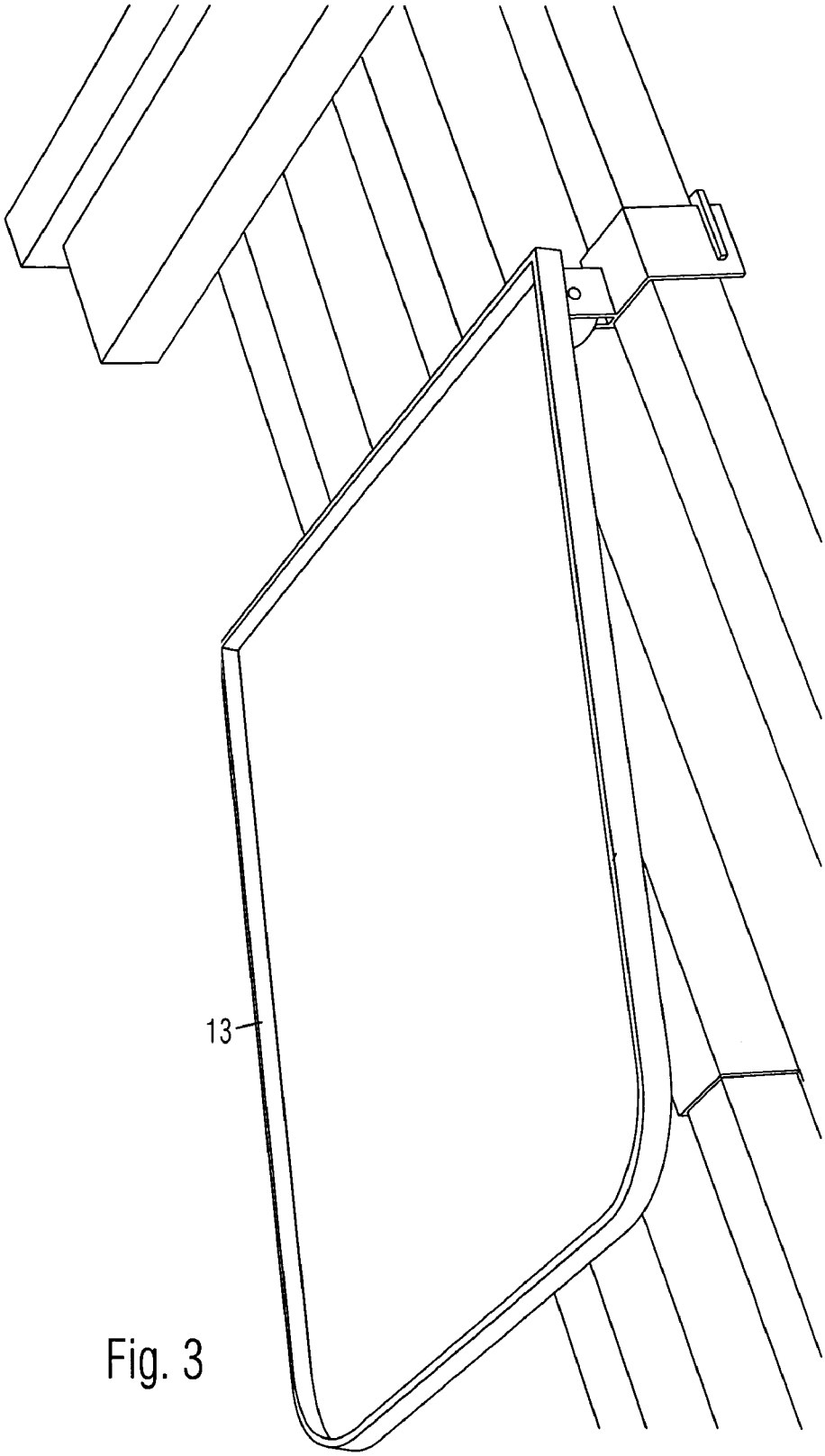
FIG. 3 shows the folding table fully folded.

FIG. 3:

Platform 13 is fully folded in FIG. 3. When folded, the upper and lower brace are generally parallel to each other. The lower pin is moved to the upper end of the longitudinal slot, and the upper pin is positioned in notch on the upper brace.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A folding table, comprising:

a platform;

C-shaped mounting brackets hinged to a proximal edge of the platform for partially wrapping around vertical supports of a handrail, wherein the mounting brackets each include slits extending down from upper edges thereof, wherein one of the mounting brackets comprises a vertically elongated bracket;

locking plates for positioning on an opposite side of the vertical supports, wherein the locking plates each include slits extending up from lower edges thereof, and the slits on the locking plates are respectively interlocked with the slits on the mounting brackets when the locking plates are respectively connected to the mounting brackets; and a folding diagonal brace connected between a lower side of the platform and the elongated bracket.

2. A folding table, comprising:

a platform;

a mounting bracket hinged to a proximal edge of the platform for attaching to a vertical support of a handrail; and a folding diagonal brace connected between a lower side of the platform and the mounting bracket, wherein the diagonal brace comprises:

an upper brace hinged to the platform;

a lower brace hinged to the mounting bracket; wherein the upper brace comprises a pair of bars with upper portions diverged away from each other, and parallel lower portions positioned against opposite sides of the lower brace;

a lower pin connected between the parallel lower portions of the bars;

a longitudinal slot in the lower brace, wherein the lower pin is positioned in the longitudinal slot;

an upper pin connected between the parallel lower portions of the bars;

a coiled slot at an upper end of the lower brace, wherein the upper pin is positioned in the coiled slot when the platform is fully raised and the diagonal brace is straightened.

3. The folding table of claim 2, further including an opening in the longitudinal slot to enable the lower pin to slide in.

4. The folding table of claim 2, further including a notch along a lower edge of the lower brace to provide clearance for the upper pin when the diagonal brace is folded.

5. A folding table, comprising:

a platform;

C-shaped mounting brackets hinged to a proximal edge of the platform for partially wrapping around vertical supports of a handrail, wherein the mounting brackets each include slits extending down from upper edges thereof, wherein one of the mounting brackets comprises a vertically elongated bracket;

locking plates for positioning on an opposite side of the vertical supports, wherein the locking plates each include slits extending up from lower edges thereof, and the slits on the locking plates are respectively interlocked with the slits on the mounting brackets when the locking plates are respectively connected to the mounting brackets; and a folding diagonal brace connected between a lower side of the platform and the elongated bracket, wherein the diagonal brace comprises:

an upper brace hinged to the platform;

a lower brace hinged to the elongated bracket; wherein the upper brace comprises a pair of bars with upper portions diverged away from each other, and parallel lower portions positioned against opposite sides of the lower brace;

a lower pin connected between the parallel lower portions of the bars;

a longitudinal slot in the lower brace, wherein the lower pin is positioned in the longitudinal slot;

an opening in the longitudinal slot to enable the lower pin to slide in;

an upper pin connected between the parallel lower portions of the bars;

a coiled slot at an upper end of the lower brace, wherein the upper pin is positioned in the coiled slot when the platform is fully raised and the diagonal brace is straightened; and a notch along a lower edge of the lower brace to provide clearance for the upper pin when the diagonal brace is folded.

* * * * *